US011698192B2

(12) United States Patent
D'Alessandro et al.

(10) Patent No.: US 11,698,192 B2
(45) Date of Patent: Jul. 11, 2023

(54) CMC COMBUSTOR PANEL ATTACHMENT ARRANGEMENT

(71) Applicant: Raytheon Technologies Corporation, Farmington, CT (US)

(72) Inventors: Salvatore D'Alessandro, Jupiter, FL (US); Gary J. Dillard, Gainesville, FL (US)

(73) Assignee: Raytheon Technologies Corporation, Farmington, CT (US)

( * ) Notice: Subject to any disclaimer, the term of this patent is extended or adjusted under 35 U.S.C. 154(b) by 73 days.

(21) Appl. No.: 17/223,136

(22) Filed: Apr. 6, 2021

(65) Prior Publication Data

US 2022/0316707 A1 Oct. 6, 2022

(51) Int. Cl.
*F23R 3/00* (2006.01)
*F23R 3/60* (2006.01)

(52) U.S. Cl.
CPC ..... *F23R 3/007* (2013.01); *F23R 3/60* (2013.01); *F23R 2900/00017* (2013.01)

(58) Field of Classification Search
CPC ..... F23R 3/007; F23R 3/60; F23R 2900/0017
See application file for complete search history.

(56) References Cited

U.S. PATENT DOCUMENTS

| | | | | |
|---|---|---|---|---|
| 3,594,109 | A | 7/1971 | Penny | |
| 3,934,408 | A | 1/1976 | Irwin | |
| 8,745,989 | B2 | 6/2014 | Prociw et al. | |
| 8,864,492 | B2 | 10/2014 | Shi et al. | |
| 9,423,130 | B2 * | 8/2016 | Prociw | F23R 3/007 |
| 11,054,136 | B2 * | 7/2021 | Hu | F23R 3/002 |
| 2010/0077719 | A1 * | 4/2010 | Wilson | F23R 3/46 415/191 |
| 2012/0102963 | A1 * | 5/2012 | Corr | F23R 3/002 60/725 |
| 2012/0204727 | A1 * | 8/2012 | Nordlund | F23R 3/005 96/221 |
| 2014/0033723 | A1 * | 2/2014 | Doerr | F23R 3/045 60/737 |
| 2015/0362190 | A1 | 12/2015 | Taylor et al. | |
| 2016/0334103 | A1 * | 11/2016 | Eastwood | F23R 3/002 |
| 2017/0067640 | A1 * | 3/2017 | Savary | F23R 3/58 |
| 2017/0159935 | A1 * | 6/2017 | Drake | F02C 7/18 |
| 2020/0102907 | A1 * | 4/2020 | Dillard | F27D 1/06 |
| 2020/0173661 | A1 * | 6/2020 | Hu | F23R 3/002 |

FOREIGN PATENT DOCUMENTS

| | | |
|---|---|---|
| EP | 1605209 | 12/2005 |

OTHER PUBLICATIONS

Extended European Search Report for EP Application No. 29166877.5 dated Aug. 25, 222.

* cited by examiner

*Primary Examiner* — Arun Goyal
*Assistant Examiner* — Henry Ng
(74) *Attorney, Agent, or Firm* — Carlson, Gaskey & Olds, P.C.

(57) ABSTRACT

A combustor liner assembly includes a first liner panel that has a first forward end and a first aft end. A second liner panel has a second forward end and a second aft end. A support band has a plurality of circumferentially spaced holes. The support band is arranged between the first liner panel and the second liner panel. The support band has a protrusion with a first angled surface and a second angled surface. The first angled surface is in engagement with the first aft end and the second angled surface in engagement with the second forward end.

19 Claims, 4 Drawing Sheets

CMC COMBUSTOR PANEL ATTACHMENT ARRANGEMENT

BACKGROUND

A gas turbine engine typically includes a fan section, a compressor section, a combustor section, and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section.

The combustor section includes a chamber where the fuel/air mixture is ignited to generate the high energy exhaust gas flow. Thus, the combustor is generally subject to high thermal loads for prolonged periods of time. Combustor liners have been proposed made of ceramic matrix composite materials, which have higher temperature capabilities. However, mounting ceramic combustor liners within the combustor may present challenges.

SUMMARY OF THE INVENTION

In one exemplary embodiment, a combustor liner assembly includes a first liner panel that has a first forward end and a first aft end. A second liner panel has a second forward end and a second aft end. A support band has a plurality of circumferentially spaced holes. The support band is arranged between the first liner panel and the second liner panel. The support band has a protrusion with a first angled surface and a second angled surface. The first angled surface is in engagement with the first aft end and the second angled surface in engagement with the second forward end.

In another embodiment according to any of the previous embodiments, the first aft end is angled with respect to an inner surface of the first liner panel. The second forward end is angled with respect to a second inner surface of the second liner panel.

In another embodiment according to any of the previous embodiments, the first aft end and the second forward end ends have an angle between 30° and 60°.

In another embodiment according to any of the previous embodiments, the first forward end and the second aft end are angled.

In another embodiment according to any of the previous embodiments, the first aft end of the first liner panel has a plurality of grooves. Each of the plurality of grooves is aligned with one of the plurality of circumferentially spaced holes.

In another embodiment according to any of the previous embodiments, the first angled surface is curved to engage with the plurality of grooves.

In another embodiment according to any of the previous embodiments, at least one of the first liner panel and the second liner panel are formed from a ceramic material.

In another embodiment according to any of the previous embodiments, the support band is formed from a metallic material.

In another exemplary embodiment, a combustor assembly includes a combustor liner that defines a combustor chamber. The combustor liner has a first liner panel that has a first forward end and a first aft end. The first aft end is angled with respect to an inner surface. A second liner panel has a second forward end and a second aft end. The second forward end is angled with respect to a second inner surface. A support band has a plurality of circumferentially spaced holes. The support band is arranged between the first liner panel and the second liner panel and is in engagement with the first aft end and the second forward end.

In another embodiment according to any of the previous embodiments, the first and second liner panels are arranged within a metallic housing. The support band is secured to the housing.

In another embodiment according to any of the previous embodiments, a plurality of spring retainers is arranged between the first liner and the housing and the second liner and the housing.

In another embodiment according to any of the previous embodiments, comprising at least one of a retainer clip arranged at the forward end and a support ring arranged at the second aft end.

In another embodiment according to any of the previous embodiments, the support band has a protrusion with first and second angled surfaces. The first aft end abuts the first angled surface and the second forward end abuts the second angled surface.

In another embodiment according to any of the previous embodiments, the first aft end and the second forward end ends have an angle between 30° and 60°.

In another embodiment according to any of the previous embodiments, at least one of the first liner panel and the second liner panel are formed from a ceramic material.

In another embodiment according to any of the previous embodiments, the support band is a metallic material.

In another exemplary embodiment, a gas turbine engine includes a compressor section, a turbine section, and a combustor section that has a plurality of combustor assemblies arranged circumferentially about an engine axis. At least one of the combustor assemblies has a liner assembly that defines a combustion chamber. The liner assembly includes a first liner panel that has a first forward end and a first aft end. A second liner panel has a second forward end and a second aft end. A support band has a plurality of circumferentially spaced holes. The support band is arranged between the first liner panel and the second liner panel. The support band has a protrusion with first and second angled surfaces. The first aft end abuts the first angled surface and the second forward end abuts the second angled surface.

In another embodiment according to any of the previous embodiments, the first aft end is angled with respect to an inner surface of the first liner panel. The second forward end is angled with respect to a second inner surface of the second liner panel.

In another embodiment according to any of the previous embodiments, the first aft end of the first liner panel has a plurality of grooves. Each of the plurality of grooves is aligned with one of the plurality of circumferentially spaced holes.

In another embodiment according to any of the previous embodiments, the liner panel is a ceramic matrix composite material and the support band is a metallic material.

The present disclosure may include any one or more of the individual features disclosed above and/or below alone or in any combination thereof.

DETAILED DESCRIPTION

Figure 1:
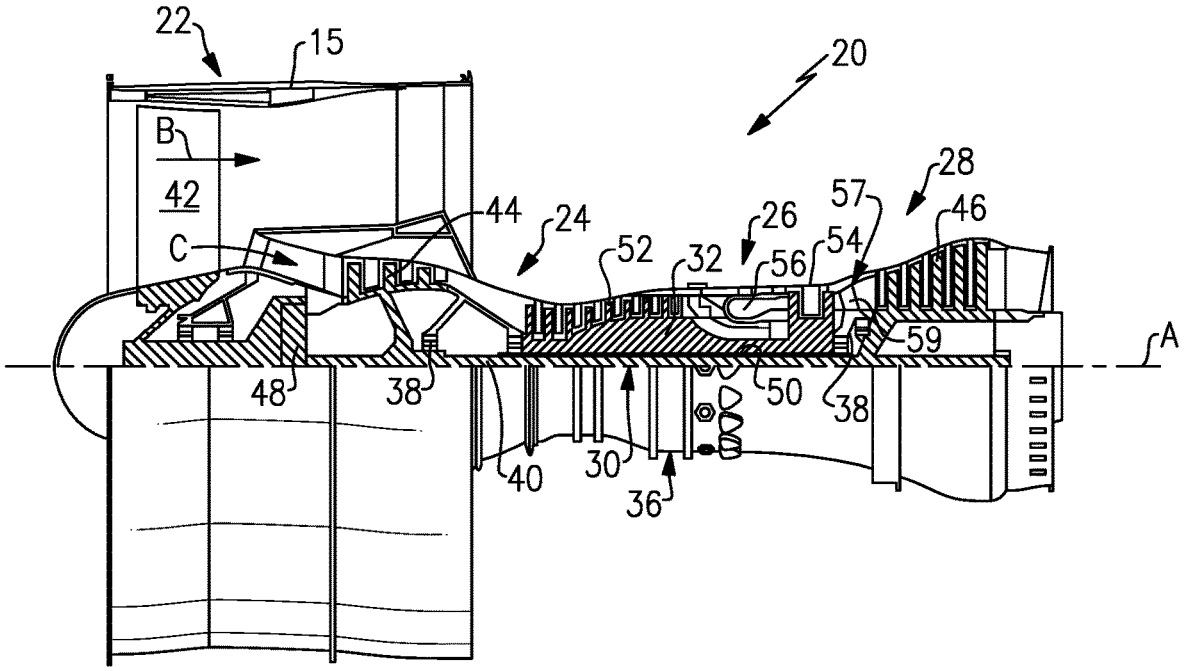
FIG. 1 schematically illustrates an example gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. The fan section 22 drives air along a bypass flow path B in a bypass duct defined within a housing 15 such as a fan case or nacelle, and also drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

The exemplary engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects, a first (or low) pressure compressor 44 and a first (or low) pressure turbine 46. The inner shaft 40 is connected to the fan 42 through a speed change mechanism, which in exemplary gas turbine engine 20 is illustrated as a geared architecture 48 to drive a fan 42 at a lower speed than the low speed spool 30. The high speed spool 32 includes an outer shaft 50 that interconnects a second (or high) pressure compressor 52 and a second (or high) pressure turbine 54. A combustor 56 is arranged in the exemplary gas turbine 20 between the high pressure compressor 52 and the high pressure turbine 54. A mid-turbine frame 57 of the engine static structure 36 may be arranged generally between the high pressure turbine 54 and the low pressure turbine 46. The mid-turbine frame 57 further supports bearing systems 38 in the turbine section 28. The inner shaft 40 and the outer shaft 50 are concentric and rotate via bearing systems 38 about the engine central longitudinal axis A which is collinear with their longitudinal axes.

The core airflow is compressed by the low pressure compressor 44 then the high pressure compressor 52, mixed and burned with fuel in the combustor 56, then expanded through the high pressure turbine 54 and low pressure turbine 46. The mid-turbine frame 57 includes airfoils 59 which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of the low pressure compressor, or aft of the combustor section 26 or even aft of turbine section 28, and fan 42 may be positioned forward or aft of the location of gear system 48.

The engine 20 in one example is a high-bypass geared aircraft engine. In a further example, the engine 20 bypass ratio is greater than about six (6), with an example embodiment being greater than about ten (10), and can be less than or equal to about 18.0, or more narrowly can be less than or equal to 16.0. The geared architecture 48 is an epicyclic gear train, such as a planetary gear system or other gear system, with a gear reduction ratio of greater than about 2.3. The gear reduction ratio may be less than or equal to 4.0. The low pressure turbine 46 has a pressure ratio that is greater than about five. The low pressure turbine pressure ratio can be less than or equal to 13.0, or more narrowly less than or equal to 12.0. In one disclosed embodiment, the engine 20 bypass ratio is greater than about ten (10:1), the fan diameter is significantly larger than that of the low pressure compressor 44, and the low pressure turbine 46 has a pressure ratio that is greater than about five 5:1. Low pressure turbine 46 pressure ratio is pressure measured prior to an inlet of low pressure turbine 46 as related to the pressure at the outlet of the low pressure turbine 46 prior to an exhaust nozzle. The geared architecture 48 may be an epicycle gear train, such as a planetary gear system or other gear system, with a gear reduction ratio of greater than about 2.3:1 and less than about 5:1. It should be understood, however, that the above parameters are only exemplary of one embodiment of a geared architecture engine and that the present invention is applicable to other gas turbine engines including direct drive turbofans.

A significant amount of thrust is provided by the bypass flow B due to the high bypass ratio. The fan section 22 of the engine 20 is designed for a particular flight condition—typically cruise at about 0.8 Mach and about 35,000 feet (10,668 meters). The flight condition of 0.8 Mach and 35,000 ft (10,668 meters), with the engine at its best fuel consumption—also known as "bucket cruise Thrust Specific Fuel Consumption ('TSFC')"—is the industry standard parameter of lbm of fuel being burned divided by lbf of thrust the engine produces at that minimum point. The engine parameters described above and those in this paragraph are measured at this condition unless otherwise specified. "Low fan pressure ratio" is the pressure ratio across the fan blade alone, without a Fan Exit Guide Vane ("FEGV") system. The low fan pressure ratio as disclosed herein according to one non-limiting embodiment is less than about 1.45, or more narrowly greater than or equal to 1.25. "Low corrected fan tip speed" is the actual fan tip speed in ft/sec divided by an industry standard temperature correction of $[(\text{Tram}\ ^\circ\ \text{R})/(518.7^\circ\ \text{R})]^{0.5}$. The "Low corrected fan tip speed" as disclosed herein according to one non-limiting embodiment is less than about 1150.0 ft/second (350.5 meters/second), and can be greater than or equal to 1000.0 ft/second (304.8 meters/second).

Figure 2:
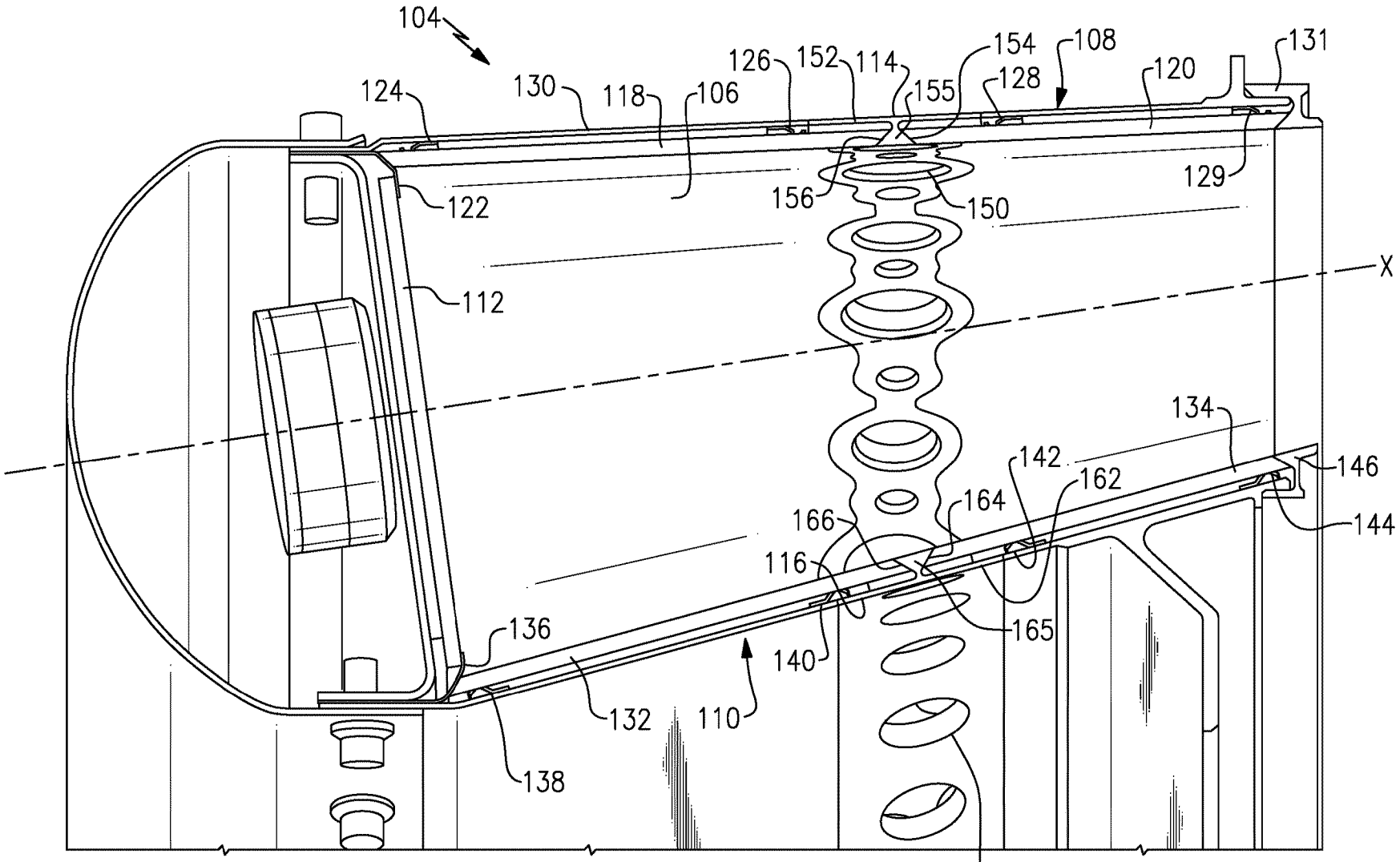
FIG. 2 schematically illustrates an example combustor assembly according to an embodiment.

FIG. 2 schematically illustrates a portion of an example combustor assembly 104. The combustor assembly 104 may be utilized in combustor section 26 of the engine 20 of FIG. 1, with products of combustion delivered downstream to the turbine section 28, for example. The combustion chamber 106 may be an annulus swept about the engine central longitudinal axis A, for example. In other examples, the combustor section 26 may include a plurality of combustor assemblies 104 disposed in an array about the engine axis A, each associated with a respective combustion chamber 106 that can have a substantially cylindrical profile, for example. Although the combustor assembly 104 is primarily discussed with respect to a turbofan gas turbine engine such as engine 20, other systems may also benefit from the teachings herein, including land-based and marine-based gas turbine engines.

The combustor assembly 104 includes an outer panel assembly 108 and an inner panel assembly 110. The inner and outer panel assemblies 108, 110 support a plurality of liner panels 118, 120, 132, 134 within a housing 130. The outer panel assembly 108 includes a forward panel 118 and an aft panel 120. The inner panel assembly 110 includes a forward panel 132 and an aft panel 134. The forward panels 118, 132 extend in an aft direction from a generally radially extending bulkhead 112. The forward panels 118, 132 and the aft panels 120, 134 are secured by inner and outer support bands 114, 116. That is, the outer forward panel 118 and the outer aft panel 120 are both engaged with the outer support band 114 and the inner forward panel 132 and the inner aft panel 134 are both engaged with the inner attachment band 116. The support bands 114, 116 may be an integral part of the combustor housing 130, and may be bolted or welded in place, for example.

The combustor liner panels 118, 120, 132, 134 may be formed of a ceramic matrix composite ("CMC") material. For example, the liner panels 118, 120, 132, 134 may be formed of a plurality of CMC laminate sheets. The laminate sheets may be silicon carbide fibers, formed into a braided or woven fabric in each layer. In other examples, the liner panels 118, 120, 132, 134 may be made of a monolithic ceramic. CMC components such as the combustor liner panels 118, 120, 132, 134 are formed by laying fiber material, such as laminate sheets or braids, in tooling, injecting a gaseous infiltrant or melt into the tooling, and reacting to form a solid composite component. The component may be further processed by adding additional material to coat the laminate sheets. The liner panels 118, 120, 132, 134 may be formed as a unitary ceramic component, for example. In some examples, the bulkhead 112 is also formed from a CMC material. CMC components may have higher operating temperatures than components formed from other materials.

The support bands 114, 116 provide support for the CMC liner panels 118, 120, 132, 134 while also having a plurality of holes 150, 160 that provide dilution holes. The support bands 114, 116 may be metallic, such as a nickel-based superalloy, for example. Each of the support bands 114, 116 has an outer platform 152, 162, respectively, that is radially outward of the combustion chamber 106. The outer platform 152, 162 is secured to the housing 130. In one example, the outer platforms 152, 162 are flush with the housing 130. In some examples, the dilution holes 150, 160 may be the same size, while in other examples, the dilution holes 150, 160 may be different sizes. Further, in some examples, the dilution holes 150 in the outer band 114 or the dilution holes 160 in the inner band 116 may be differing sizes within the band. For example, the dilution holes 160 may alternate between different sizes about the support band 114, 116, depending on the particular combustor arrangement.

Several additional structures may also secure the panels 118, 120, 132, 134 within the assembly 104. The forward liner panels 118, 132 are secured at a forward end of the combustion chamber 106 via retainer structures 122, 136, respectively. The structures 122, 136 may also secure the bulkhead 112. The aft liner panels 120, 134 are secured at an aft end of the combustion chamber 106 via support rings 131, 146. The liner panels 118, 120, 132, 134 may also be held in place by one or more spring supports 124, 126, 128, 129, 138, 140, 142, 144. The retainer structures 122, 136, spring supports 124, 126, 128, 129, 138, 140, 142, 144, and support rings 131, 146 may be metallic, such as a nickel-based superalloy, for example. The spring supports 124, 126, 128, 129, 138, 140, 142, 144 bias the liner panels 118, 120, 132, 134 radially, while accommodating differences in thermal expansion within the assembly.

The outer and inner support bands 114, 116 also provide support to the liner panels 118, 120, 132, 134. A protrusion 155 extends inward from the outer platform 152 of the outer support band 114 towards the combustion chamber 106. The protrusion 155 has first and second angled surfaces 154, 156 for engagement with the aft and forward liner panels 120, 118, respectively. A protrusion 165 extends outward from the inner platform 162 of the support band 116 towards the combustion chamber 106. The protrusion 165 has first and second angled surfaces 164, 166 for engagement with the aft and forward liner panels 134, 132, respectively. The angled surfaces 154, 156, 164, 166 support the liner panels 118, 120, 132, 134 in the radial direction while also accommodating differences in thermal expansion between the band 114, 116 and the panels 118, 120, 132, 134.

Figure 3:
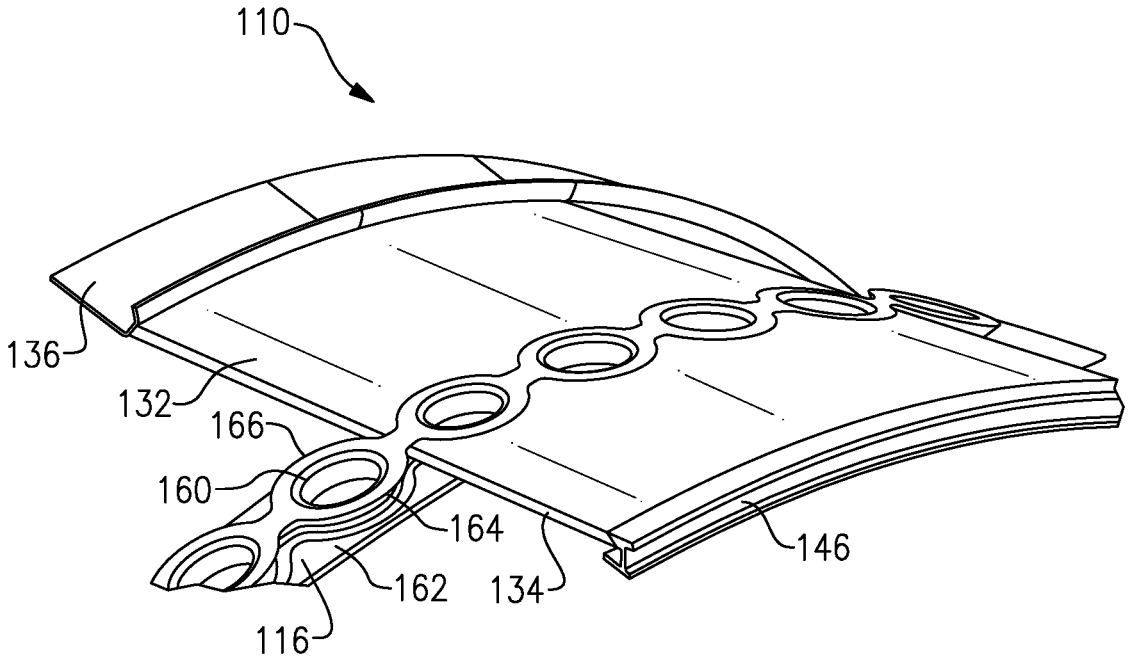
FIG. 3 schematically illustrates a portion of an example inner combustor liner assembly.

FIG. 3 schematically illustrates a portion of the example inner combustor liner assembly 110. The forward liner panel 132 abuts the retainer structure 136 at a forward end, and the aft panel 134 abuts an aft support ring 146 at an aft end. The retainer structure 136 secures the forward end of the panel 132 to the housing 130 and may also secure the bulkhead 112, for example. The inner support band 116 is arranged between the forward and aft liner panels 132, 134. The outer platform 162 of the support band 116 abuts outer surfaces 180, 184 of the liner panels 132, 134, while the angled surfaces 164, 166 abut the forward end 196 of the aft panel 134 and the aft end 194 of the forward panel 132 (shown in FIG. 5).

Figure 4:
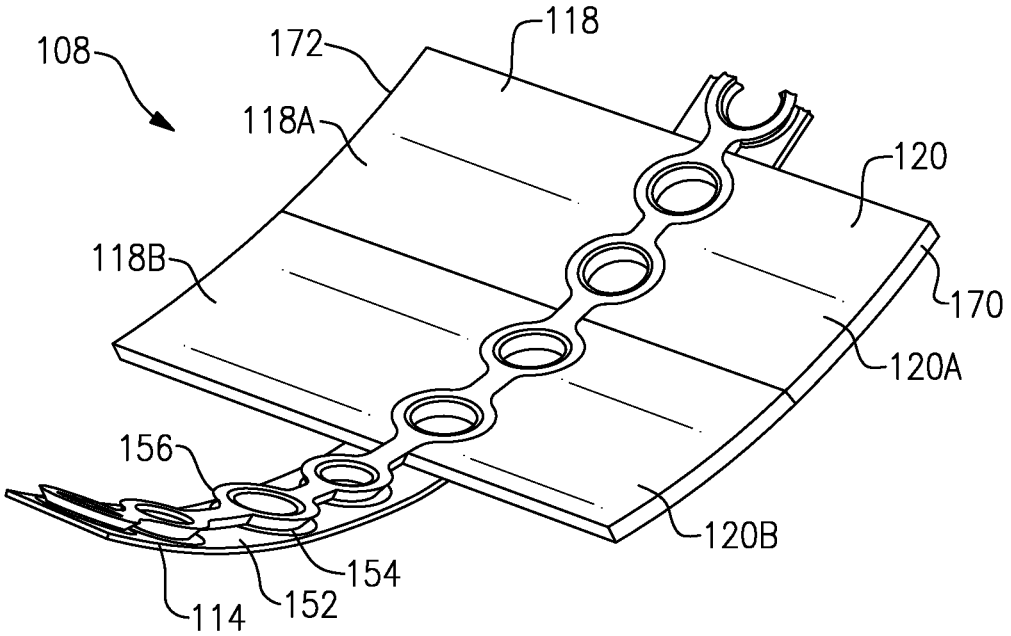
FIG. 4 schematically illustrates a portion of an example outer combustor liner assembly.

FIG. 4 schematically illustrates a portion of the example outer combustor liner assembly 108. The outer liner panels 118, 120 and outer support band 114 are arranged in a similar manner as the inner combustor liner assembly 110. A forward end 172 of the forward liner panel 118 is configured to engage the retainer structure 122, while an aft end 170 of the aft liner panel 120 is configured to engage the support ring 131 (shown in FIG. 2). The forward liner panel 118 and aft liner panel 120 may each be formed from a plurality of panel segments 118A, 118B, 120A, 120B, respectively. In this example, the forward liner panel 118 and aft liner panel 120 have segments that are the same width in a circumferential direction, and thus the forward liner panel 118 and aft liner panel 120 have the same number of segments. However, in other examples, the forward and aft liner panels 118, 120 may have panel segments of different sizes and/or a different number of segments.

Figure 5:
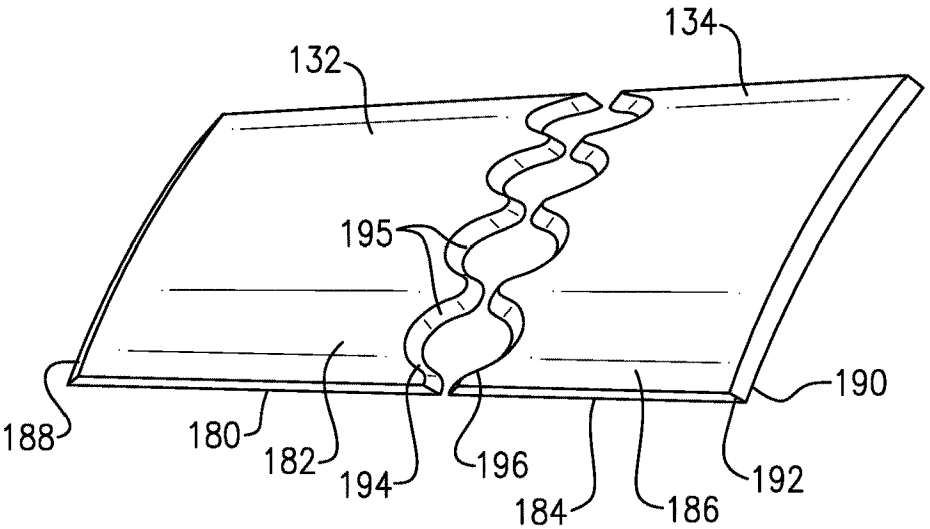
FIG. 5 schematically illustrates a portion of the example combustor liner assembly.

FIG. 5 schematically illustrates a portion of the example combustor liner assembly 110. The forward liner panel 132 extends between a forward end 188 and an aft end 194, and the aft liner panel 134 extends between a forward end 196 and an aft end 190. The liner panels 132, 134 each have an inner surface 182, 186, respectively, and an outer surface 180, 184, respectively, relative to the combustion chamber 106. The inner surfaces 182, 186 are substantially parallel to the outer surfaces 180, 184. The inner surfaces 182, 186 are exposed to the hot gases in the combustion chamber 106, while the outer surfaces 180, 184 are arranged near the housing and may engage with the spring supports 124, 126, 128, 129, 138, 140, 142, 144. In some examples, cooling air may flow between the housing 130 and the outer surfaces 180, 184 to cool the panels 132, 134.

The forward and aft ends 188, 194, 196, 190 are angled with respect to the inner and outer surfaces 182, 186, 180, 184. The ends may have an angle 192 with respect to the outer surfaces 184 of between 30° and 60°, for example. In a further embodiment, the angle 192 may be about 45°. The forward and aft ends 188, 194, 196, 190 may all have the same angle or may have different angles. The angled forward end 188 of the forward liner panel 132 and the angled aft end 190 of the aft liner panel 134 are engaged with retainer structure 136 and support ring 146, respectively (shown in FIG. 2).

The aft end 194 of the forward liner panel 132 and the forward end 196 of the aft liner panel 134 may have a plurality of grooves 195. In this example, the grooves 195 are spaced circumferentially along the ends 194, 196 to form a scallop pattern. The grooves 195 on the forward liner panel 132 and the aft liner panel 134 are aligned with one another. The grooves 195 are also aligned with the holes 150 of the support band 116. In other words, each hole 150 is aligned with a groove 195 in the circumferential direction, such that the holes 150 on the support band 116 fit within the grooves 195. The angled ends 194, 196 form a partially conical shape for engagement with the angled surfaces 166, 164 of the support band 116. The angled surfaces 164, 166 also provide a wavy shape that provides partially conical portions for engagement with the angled ends 194, 196. This arrangement permits a large amount of the combustion chamber 106 to be lined with a ceramic material. The angled surface arrangement also provides sealing between the components.

Figure 6:
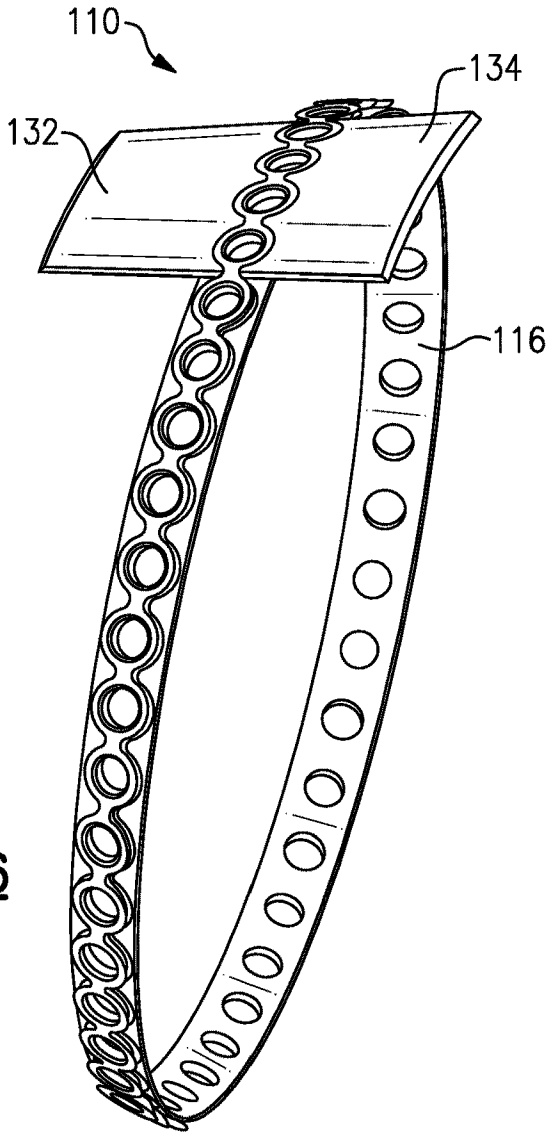
FIG. 6 schematically illustrates a portion of the example combustor liner assembly.

FIG. 6 schematically illustrates a portion of the example combustor liner assembly. The support band 116 extends circumferentially about the combustion chamber 106. A plurality of segments of liner panels 132, 134 are configured to be arranged circumferentially about the support band 116 to form the inner combustor liner assembly 110. Although the inner combustor liner assembly 110 is shown, the outer combustor liner assembly 108 may be configured similarly, with a unitary support band 114 extending circumferentially about the combustion chamber 106. Although a plurality of liner panel segments are shown, in some examples, one or more of the liner panels 118, 120, 132, 134 may be a full hoop extending circumferentially about the support band 114, 116.

Metallic combustor liners have limited maximum temperature capabilities and may require large amounts of cooling. CMC combustor liners provide a significant increase in thermal capabilities. However, mounting and sealing a CMC combustor liner to adjacent metallic structure presents challenges due to differences in thermal expansion and poor local load capability in the CMC. The disclosed support bands with integral dilution holes support CMC combustor liner panels without the need for additional stud fasteners. The support band may be an integral part of the combustor outer housing 130, and may be bolted or welded in place, for example. The disclosed support band arrangement also permits existing combustor architecture to be used with minimal impact to the required envelope. The reduced need for support studs on the backside surface of the CMC liner panel allows cooling flow to be supplied more uniformly along the surface. Individual panels are replaceable for maintainability and reduced manufacturing cost. Although a straight wall combustor with a single dilution hole support band is shown, the teachings of this disclosure may apply to a kinked wall combustor, which has a wall with at least one angled portion, in other examples.

In this disclosure, "generally axially" means a direction having a vector component in the axial direction that is greater than a vector component in the circumferential direction, "generally radially" means a direction having a vector component in the radial direction that is greater than a vector component in the axial direction and "generally circumferentially" means a direction having a vector component in the circumferential direction that is greater than a vector component in the axial direction.

Although an embodiment of this invention has been disclosed, a worker of ordinary skill in this art would recognize that certain modifications would come within the scope of this disclosure. For that reason, the following claims should be studied to determine the true scope and content of this disclosure.

The invention claimed is:

1. A combustor liner assembly, comprising a first liner panel having a first forward end and a first aft end, the first aft end including a first plurality of grooves spaced circumferentially about an axis;

a second liner panel having a second forward end and a second aft end; the second forward end including a second plurality of grooves spaced circumferentially about the axis;

a support band arranged between the first liner panel and the second liner panel, the support band including:

a platform having a plurality of holes spaced circumferentially about the axis, and a protrusion extending radially relative to the axis from the platform and including a first angled surface and a second angled surface, the first angled surface including a first plurality of portions that are spaced circumferentially about the axis and each of the first plurality of portions partially surrounds a first axial side of and includes a partially conical shape defined about one of the plurality of holes, and the second angled surface including a second plurality of portions that are spaced circumferentially about the axis and each of the second plurality of portions partially surrounds a second axial side of and includes a partially conical shape defined about the one of the plurality of holes; and wherein the first angled surface is in engagement with the first aft end such that the first plurality of portions engage with the first plurality of grooves, and the second angled surface is in engagement with the second forward end such that the second plurality of portions engage with the second plurality of grooves.

2. The combustor liner assembly of claim 1, wherein the first aft end is angled between 30° and 60° with respect to a first inner surface of the first liner panel and the second forward end is angled between 30° and 60° with respect to a second inner surface of the second liner panel.

3. The combustor liner assembly of claim 2, wherein the first forward end is angled between 30° and 60° with respect to the first inner surface and the second aft end is angled between 30° and 60° with respect to the second inner surface.

4. The combustor liner assembly of claim 1, each groove of the first plurality of grooves and the second plurality of grooves is aligned circumferentially with the one of the plurality of holes.

5. The combustor liner assembly of claim 1, wherein at least one of the first liner panel and the second liner panel are formed from a ceramic material and the support band is formed from a metallic material.

6. The combustor liner assembly of claim 1, wherein the first liner panel and the second liner panel axially overlap with the platform and are constrained radially between the platform and the first angled surface and the second angled surface, respectively.

7. A combustor assembly, comprising:

an outer panel assembly including:

a first liner panel having a first inner surface, a first forward end, and a first aft end, the first aft end angled between 30° and 60° with respect to the first inner surface, a second liner panel having a second inner surface, a second forward end, and a second aft end, the second forward end angled between 30° and 60° with respect to the second inner surface, and an outer support band having a plurality of outer holes spaced circumferentially about an axis, the outer support band arranged between the first liner panel and the second liner panel and in engagement with the first aft end and the second forward end;

an inner panel assembly comprising:

a third liner panel having a third inner surface, a third forward end, and a third aft end, the third aft end angled between 30° and 60° with respect to the third inner surface, a fourth liner panel having a fourth inner surface, a fourth forward end and a fourth aft end, the fourth forward end angled between 30° and 60° with respect to the fourth inner surface, and an inner support band having a plurality of inner holes spaced circumferentially about the axis, the inner support band arranged between the third liner panel and the fourth liner panel and in engagement with the third aft end and the fourth forward end; and wherein a combustion chamber is defined between the outer panel assembly and the inner panel assembly, and wherein:

the first aft end of the first liner panel includes a first plurality of grooves spaced circumferentially about the axis;

the second forward end of the second liner panel includes a second plurality of grooves spaced circumferentially about the axis;

the outer support band has a protrusion with a first angled surface and a second angled surface, the first angled surface including a first plurality of portions that are spaced circumferentially about the axis and each of the first plurality of portions partially surrounds a first axial side of and includes a partially conical shape defined about one of the plurality of outer holes, and the second angled surface including a second plurality of portions that are spaced circumferentially about the axis and each of the second plurality of portions partially surrounds a second axial side of and includes a partially conical shape defined about the one of the plurality of outer holes;

and the first aft end abuts the first angled surface such that the first plurality of portions engage with the first plurality of grooves, and the second forward end abuts the second angled surface such that the second plurality of portions engage with the second plurality of grooves.

8. The combustor assembly of claim 7, wherein the first liner panel and the second liner panel are arranged within a metallic housing, and the outer support band is secured to the metallic housing.

9. The combustor assembly of claim 8, wherein a plurality of spring retainers are arranged radially between the first liner panel and the metallic housing and the second liner panel and the metallic housing.

10. The combustor assembly of claim 8, wherein:

the first liner panel and the third liner panel are supported relative to the metallic housing by retainer structures engaging the first forward end and the third forward end; and the second liner panel and the fourth liner panel are supported relative to the metallic housing by a support ring engaging the second aft end and fourth aft end.

11. The combustor assembly of claim 8, wherein the first liner panel, second liner panel, third liner panel, and fourth liner panel are formed from a ceramic material.

12. The combustor assembly of claim 8, wherein the inner support band and the outer support band are a metallic material.

13. The combustor assembly of claim 7, wherein the outer panel assembly is radially outward of the inner panel assembly relative to the axis and the combustion chamber is defined by an annulus between the outer panel assembly and the inner panel assembly.

14. The combustor assembly of claim 7, wherein:

the third aft end of the third liner panel includes a third plurality of grooves spaced circumferentially about the axis;

the fourth forward end of the fourth liner panel includes a fourth plurality of grooves spaced circumferentially about the axis;

the inner support band has a protrusion with a third angled surface and a fourth angled surface, the third angled surface including a third plurality of portions that are spaced circumferentially about the axis and each of the third plurality of portions partially surrounds a first axial side of and includes a partially conical shape defined about the one of the plurality of inner holes, and the fourth angled surface including a fourth plurality of portions that are spaced circumferentially about the axis and each of the fourth plurality of portions partially surrounds a second axial side of and includes a partially conical shape defined about the one of the plurality of inner holes; and the third aft end abuts the third angled surface such that the third plurality of portions engage with the third plurality of grooves, and the fourth forward end abuts the fourth angled surface such that the fourth plurality of portions engage with the fourth plurality of grooves.

15. A gas turbine engine, comprising:

a compressor section;

a turbine section;

a combustor section including a liner assembly defining a combustion chamber, the liner assembly comprising:

a first liner panel having a first forward end and a first aft end, the first aft end including a first plurality of grooves spaced circumferentially about an axis;

a second liner panel having a second forward end and a second aft end, the second forward end including a second plurality of grooves spaced circumferentially about the axis;

a support band arranged between the first liner panel and the second liner panel, the support band including:

a platform having a plurality of holes spaced circumferentially about the axis, and a protrusion extending radially relative to the axis from the platform and including a first angled surface and a second angled surface, the first angled surface including a first plurality of portions that are spaced circumferentially about the axis and each of the first plurality of portions partially surrounds a first axial side of and includes a partially conical shape defined about one of the plurality of holes, and the second angled surface including a second plurality of portions that are spaced circumferentially about the axis and each of the second plurality of portions partially surrounds a second axial side of and includes a partially conical shape defined about the one of the plurality of holes;

and wherein the first aft end abuts the first angled surface such that the first plurality of portions engage with the first plurality of grooves, and the second forward end abuts the second angled surface such that the second plurality of portions engage with the second plurality of grooves.

16. The gas turbine engine of claim 15, wherein the first aft end is angled between 30° and 60° with respect to a first inner surface of the first liner panel and the second forward end is angled between 30° and 60° with respect to a second inner surface of the second liner panel.

17. The gas turbine engine of claim 15, wherein each groove of the first plurality of grooves and the second plurality of grooves is aligned circumferentially with the one of the plurality of holes.

18. The gas turbine engine of claim 15, wherein the first liner panel and the second liner panel are a ceramic matrix composite material and the support band is a metallic material.

19. The gas turbine engine of claim 15, wherein the first liner panel and the second liner panel are arranged within a metallic housing, and the support band is secured to the metallic housing such that the platform is flush with the outer surface of the metallic housing.

* * * * *